United States Patent [19]

Konersmann

[11] Patent Number: 4,488,381

[45] Date of Patent: Dec. 18, 1984

[54] CUTTER APPARATUS

[75] Inventor: Erhard Konersmann, Wallisellen, Switzerland

[73] Assignee: Werkzeugmaschinenfabrik Oerlikon-Bührle AG, Zürich, Switzerland

[21] Appl. No.: 418,417

[22] Filed: Sep. 15, 1982

[30] Foreign Application Priority Data

Sep. 30, 1981 [CH] Switzerland ..... 6294/81

[51] Int. Cl.[3] ..... B24B 41/04

[52] U.S. Cl. ..... 51/98 R; 51/99; 51/34 H

[58] Field of Search ..... 51/98 R, 34 H, 99, 219, 51/277, 220, 225, 98 BS; 76/101 A, 101 R, 28, 29

[56] References Cited

U.S. PATENT DOCUMENTS

| | | | |
|---|---|---|---|
| 76,755 | 4/1868 | Hammer | 51/34 H |
| 2,107,566 | 2/1938 | Gardner | 51/98 R |
| 4,136,489 | 1/1979 | Von Allmen | 51/98 BS |

FOREIGN PATENT DOCUMENTS

| | | | |
|---|---|---|---|
| 144136 | 11/1951 | Australia | 51/98 R |
| 1156329 | 10/1963 | Fed. Rep. of Germany . | |
| 1390173 | 1/1965 | France . | |
| 2372001 | 6/1978 | France . | |
| 308958 | 7/1955 | Switzerland | 51/98 R |

*Primary Examiner*—Harold D. Whitehead
*Attorney, Agent, or Firm*—Werner W. Kleeman

[57] ABSTRACT

At a cutter apparatus for producing surfaces of a cutter head at a hardened steel cutter blade there is provided for monitoring the wear and for its rapid compensation a mounting or support device for a material-removal or cutting grinding disk and a power take-off wheel which is axially displaceable with respect to a pivot axis. Additionally, the width of the power take-off wheel is greater, by the amount of an adjustment path for the cutting grinding disk, than the width of a drive belt for the power take-off wheel. Furthermore, there is provided a reference surface for adjusting a movement plane of the cutter grinding disk in a desired cutting plane.

9 Claims, 4 Drawing Figures

CUTTER APPARATUS

CROSS-REFERENCE TO RELATED APPLICATION

This application is related to my commonly assigned copending U.S. application Ser. No. 06/107,133, filed Dec. 26, 1979, now U.S. Pat. No. 4,348,839 issued Sept. 14, 1982, and entitled "METHOD FOR PRODUCING SURFACE AT A BLADE CUTTER HEAD FORMED OF HARDENED CUTTER BLADE STEEL AND APPARATUS FOR THE PERFORMANCE OF THE METHOD".

BACKGROUND OF THE INVENTION

The present invention relates to a new and improved construction of cutter apparatus for producing surfaces of a cutter head at a hardened steel cutter blade.

Generally speaking, the cutter apparatus of the present development is of the type comprising a drive motor, a belt drive for driving a cutter grinding disk mounted for pivotable movement about a pivot axis, wherein the belt drive comprises a drive pulley or wheel operatively correlated with the drive motor, a power take-off wheel operatively correlated with the cutter grinding disk, and a pulley belt.

In European patent application No. 00 14270 there is disclosed to the art a cutter apparatus of the aforementioned type. With this cutter apparatus the material-removal or cutter grinding disk can be pivoted out of a rest position about a pivot axis into a work position. A portion of a steel cutter blade which has been chucked in a holder device can thus be cut away or machined.

The cutting-off or cutter grinding disk which is used with such cutter apparatus is preferably of cylindrical configuration. In particular, there is only loaded or used for the cutting work one of both circular edges. Hence, the cutter grinding disk tends to wear more rapidly at such circular edge. Now if, for instance, there is to be freely cut a chip or free surface at a series of rod-shaped cutter blades, wherein the setting of the holder device for the rod-shaped cutters remains unaltered from cutter blade to cutter blade, then it can arise that at the last ground cutters there still remains a greater layer of material which is to be ground than at the initially machined cutters. During the regrinding of the cutters or cutter blades at a cutter grinding machine, where a great number of cutters or cutter blades are simultaneously chucked and only very little material is removed during each pass of the grinding disk, the cutters which were last processed or machined in the cutter apparatus therefore require appreciably more time for the regrinding work than the initially machined cutters or cutter blades. This means that the average grinding time per cutter blade is always greater than would be otherwise the case if there always were present an ideally adjusted cutter grinding disk.

SUMMARY OF THE INVENTION

Therefore, with the foregoing in mind it is a primary object of the present invention to provide a new and improved construction of cutter apparatus of the aforementioned type which is not afflicted with the previously discussed drawbacks and shortcomings of the state-of-the-art constructions.

Another and more specific object of the present invention is directed to a new and improved construction of cutter apparatus of the aforementioned type wherein the wear of the cutter grinding disk is continuously monitored and can be rapidly compensated.

Now in order to implement these and still further objects of the invention, which will become more readily apparent as the description proceeds, the cutter apparatus of the present development is manifested by the features that there is provided a mounting or support device for the cutter grinding disk and the power take-off wheel. This mounting device can be displaced towards the drive motor and axially with respect to the pivot axis. The width of the power take-off wheel exceeds the width of the belt pulley by an amount which corresponds to the adjustment path for the cutter grinding disk. Additionally, there is provided an adjustable reference surface in order to adjust a movement plane of the cutter grinding disk in a desired cutting plane.

Some of the more noteworthy advantages of the invention worthy of here mentioning reside in the fact that, the cutter grinding disk can be adjusted during operation without altering the remaining parameters which have already been set. Additionally, it is possible when carrying out the machining operation with extremely thin cutter grinding disks to work with a number of successive parallel cuts. This is done in order to avoid any bending of the cutter grinding disk towards the surface which is to be cut, something which particularly then can arise if initially that circular edge impacts against the workpiece which faces away from the surface which is to be cut.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
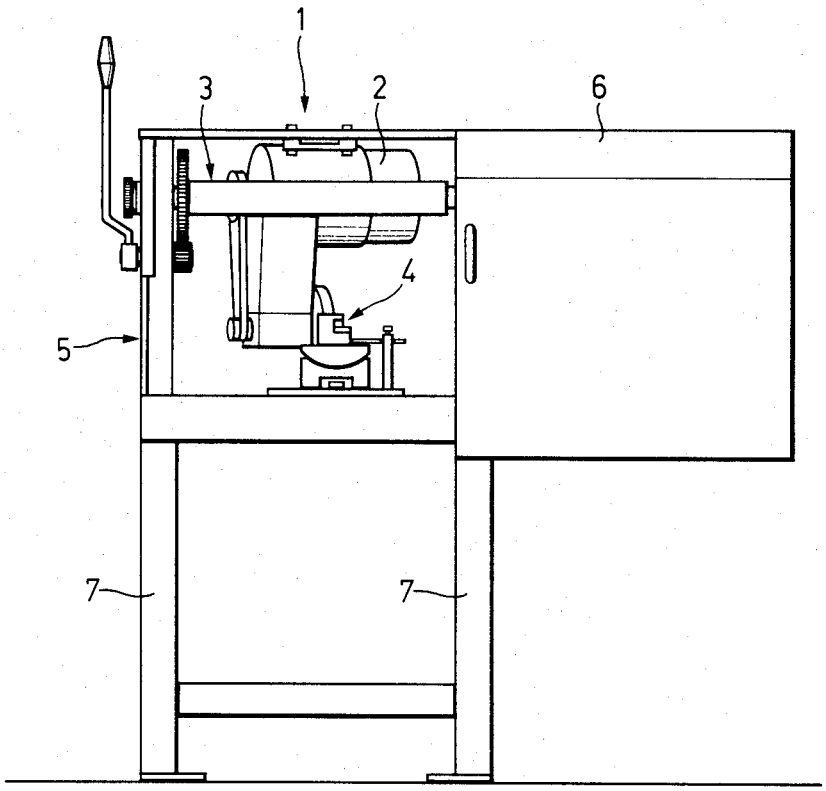
FIG. 1 is a schematic front view of a cutter apparatus constructed according to the invention.

Describing now the drawings, in FIG. 1 there is illustrated an exemplary embodiment of a cutter apparatus 1 constructed according to the teachings of the invention. This cutter apparatus 1 essentially comprises a drive motor 2, a mounting or support device 3, a holder device or holder 4 for a steel cutter blade, a housing 5, a door 6 which is arranged to be horizontally displaceable, and supports 7 or uprights for the housing 5.

In FIG. 2 there is again shown the housing 5. This housing 5 comprises a floor or base 8, the respective side walls 9 and 10 and a ceiling or cover member 11. A further side wall 12 closes the housing 5 towards the rear. By means of the threaded bolts or screws 13 and 14 or equivalent fastening expedients the drive motor 2 is connected with the ceiling or cover member 11. Connected in conventional fashion to a drive shaft 15 is a drive pulley or wheel 16 for a pulley belt 17. Also useful as the pulley belt 17 is a toothed belt.

A rectangular frame 18 surrounds the drive motor 2 at all sides, as particularly apparent by inspecting FIG.

3. At the frame member or frame 18 there is additionally attached a casing or cabinet 19 which, as evidenced from the showing of FIG. 4, carries at the end thereof facing away from the frame 18 a bearing or support block 20 or equivalent structure. Threaded bolts or screws 21 and 22 serve for the attachment of the bearing block 20 at the cabinet or casing 19 (FIG. 2).

Provided within the bearing block 20 are bearings 23 for a rotatable shaft 24. This rotatable shaft 24 carries at one end thereof a power take-off wheel or pulley 25 and at its other end a material-removal or cutter grinding disk 26 which is partially surrounded by a protective housing 27, as best seen by referring to FIGS. 2 and 4.

Figure 2:
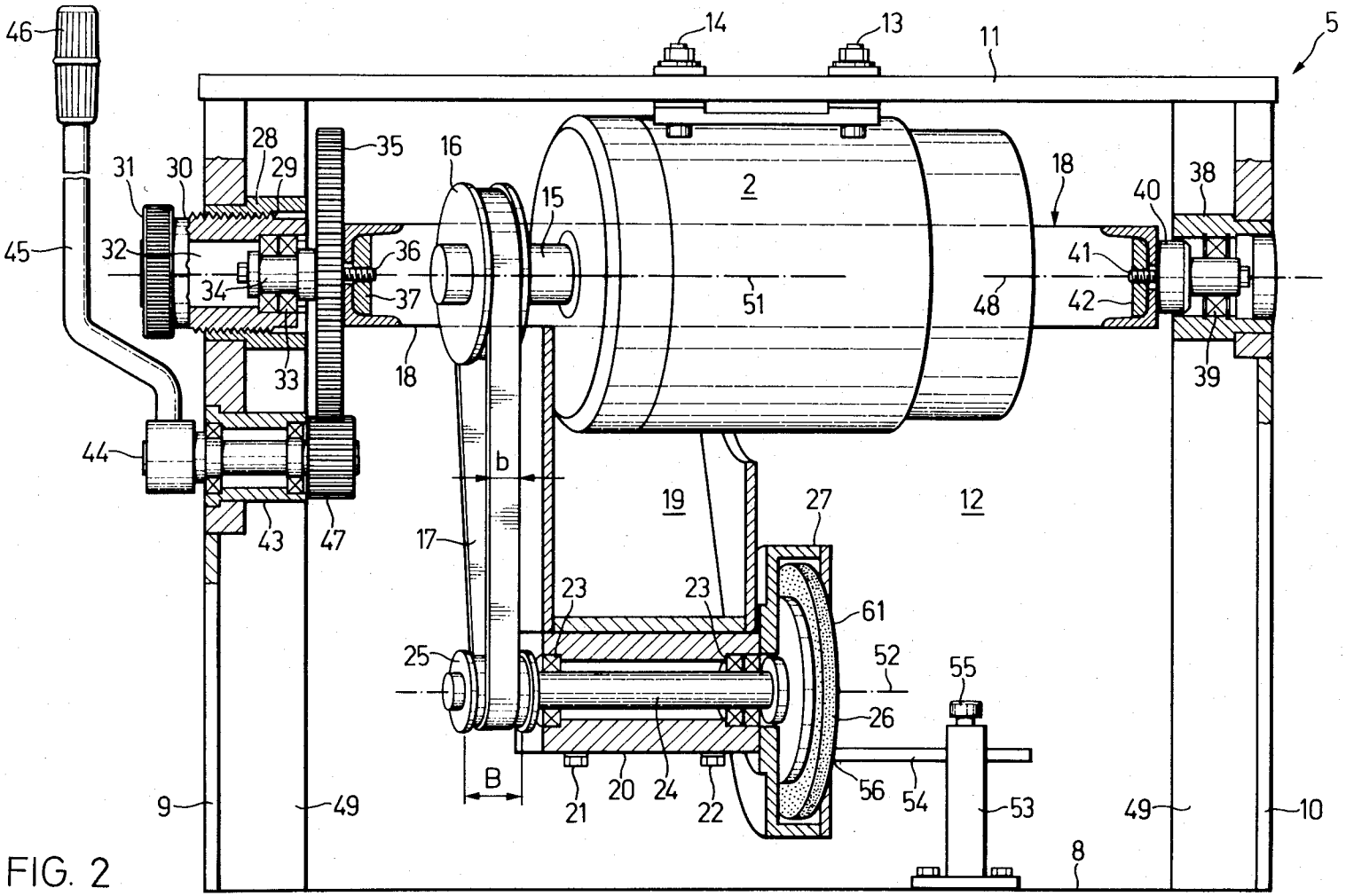
FIG. 2 is an enlarged front view, partially in section, of a portion of the cutter apparatus depicted in FIG. 1.

As shown in FIG. 2, a bearing bushing 28 is inserted into the side wall 9. The inner surface of the bearing bushing 28 is provided with threads 29. Threaded into these bushing threads 29 is a sleeve member 30 which is provided at one end with a handgrip or knurled knob 31. The inner surface 32 of the sleeve member 30 houses bearings or bearing means 33 for a bolt member 34 which carries at its end facing away from the bearing means 33 a gear 35 which is fixedly connected with the frame 18. To that end, the bolt member 34, in turn, is fixedly connected with the frame or frame means 18, and specifically, by means of a threaded bolt or screw 36 is threadably connected with a counter element or piece 37 provided in the frame 18.

There is likewise inserted into the side wall 10 a bearing bushing 38 for a bearing 39. In the bearing 39 there is arranged to be displaceable a bolt member 40 which, by means of a threaded bolt or screw 41 in conjunction with a counter piece or element 42, rigidly connects the bolt member 40 with the frame 18.

Beneath the bearing bushing 28 there is also inserted in the side wall 9 a bearing bushing 43 for a shaft member 44. This shaft member 44 supports at its one end a lever member 45 equipped with a handgrip or handle 46, and such shaft member 44 carries at its other end a wide pinion 47 which meshes with the gear 35.

The bearing bushings 28 and 38 are coaxially arranged with respect to a pivot axis 48. This means that the frame 18 mounted in the bearings 33 and 39 along with the cabinet or casing 19 and the bearing block 20, which collectively form a mounting or support device 3 for the cutting grinding disk 26, are pivotable about the pivot axis 48.

Figure 3:
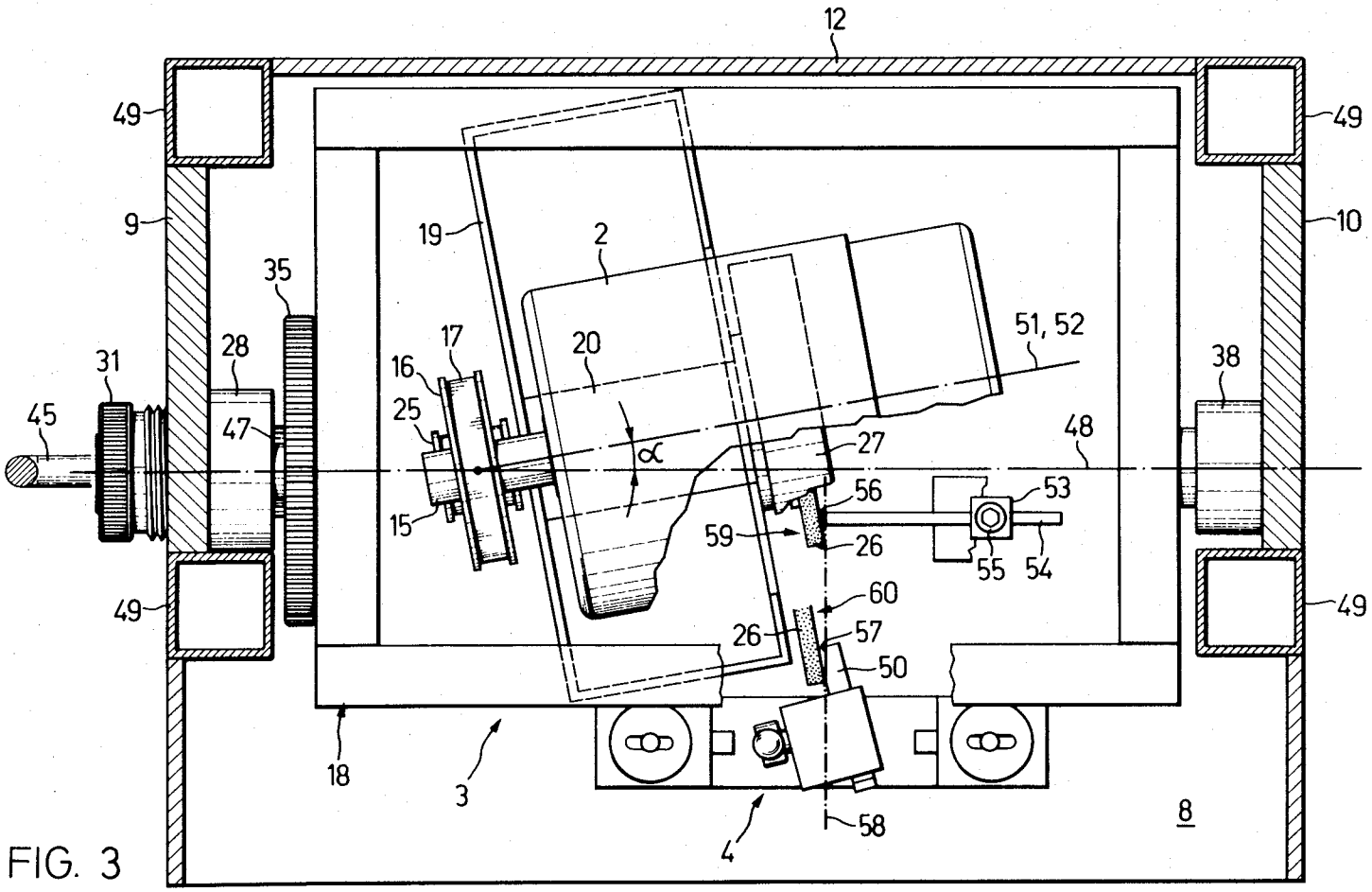
FIG. 3 is a top plan view of the cutter apparatus shown in FIG. 2.

From the showing of FIG. 3 there will be additionally recognized four support members or supports 49 which support the side walls 9 and 10 and the rear 12. Further, there will be seen that there is arranged in known manner at the floor or base 8 the holder device or holder 4 for a steel cutter blade 50. Additionally, there will be seen that there is provided an axis 51 for the drive pulley or wheel 16. This axis 51 extends parallel to an axis 52 for the cutter grinding disk 26 and the power take-off pulley or wheel 25. The axes 51 and 52 are inclined through an acute angle $\alpha$ with respect to the pivot axis 48, and such angle preferably amounts to about 10°. The cabinet or casing 19 likewise is arranged at essentially right angles to the axes 51 and 52.

Figure 4:
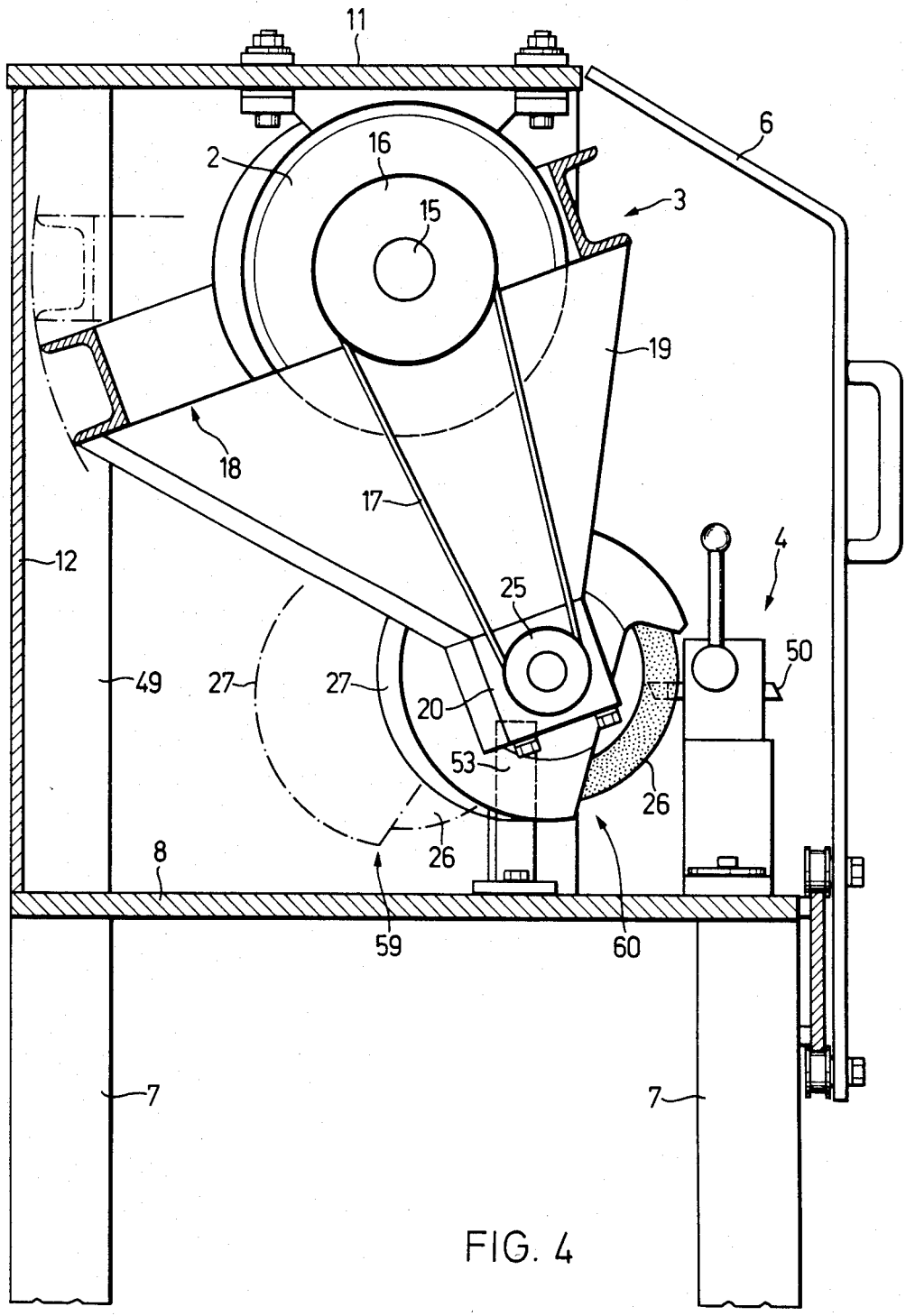
FIG. 4 is a side view of the cutter apparatus depicted in FIG. 2.

Additionally, in FIGS. 2, 3 and 4 there will be further recognized a support member 53 in which there is fixedly positionable and displaceable substantially parallel to the pivot axis 48 by means of a threaded bolt or screw 55 or equivalent fastening expedient a carrier or support 54. This carrier or support 54 carries at its end a reference surface 56.

For freely cutting a surface 57 at a steel cutter blade or cutter 50 initially the holder device 4 is adjusted in known manner such that the surface 57 which is to be freely cut is located substantially parallel to a movement plane 58 which has been illustrated by a broken line in FIG. 3. In both FIGS. 3 and 4 there will be recognized a rest position 59, shown in phantom lines in FIG. 4, as well as a work position 60, shown in full lines in such FIG. 4, for the cutter grinding disk 26. By pulling upon the hand grip 46, wherein the applied force is transmitted by means of the lever 45, the shaft 44, the pinion 47 and the gear 35 to the mounting or support device 3, the cutter grinding disk 26 is pivoted into its work or effectual position 60. Consequently, it is possible to compare the position of the cutter grinding disk 26, which is decisive in the direction of the pivot axis 48, and thus, the movement plane 58 with the, for instance, surface 57 which has been indicated at the steel cutter blade or cutter 50. By rotating the handgrip or knob 31 it is possible to laterally shift, and thus, set or adjust the movement plane 58. In so doing, the bolt member 40 slides upon the coacting bearing 39 and the gear 35 slides laterally upon the wider pinion 47.

At the support member 53 there is likewise set or adjusted the carrier or support member 54 with the reference surface 56 located at the movement plane 58, so that the cutter grinding disk 26 slightly contacts such in its rest or ineffectual position 59.

In order to cut a first steel cutter blade 50 a pulling action is simply exerted upon the handgrip 46 while the cutter grinding disk 26 rotates. The ratio of the diameter of the wide pinion 47 and the gear 35 with respect to one another as well as the length of the lever member or lever 45 allows for an advantageous force transmission.

If with the same setting of the holder device 4 there have already been machined in this manner a number of steel cutter blades, and if there is noticeable wear of the cutter grinding disk 26 at a circular edge 61 thereof confronting the workpiece i.e. blade 50, in that during passage thereof at the reference surface 56 there are no longer produced any sparks, then by appropriately rotating the handgrip 31 an adjustment must be made for such length of time until the cutter grinding disk 26 again produces a certain amount of sparks at the reference surface 56.

With lateral displacement of the mounting or support device 3 along the pivot axis 48 the drive pulley or wheel 16 remains in place and the power take-off pulley or wheel 25 shifts along the pivot axis 48. It is for this reason that the width B of the power take-off pulley or wheel 25 is chosen such that it exceeds the width b of the toothed pulley belt by the displacement path for the mounting or device 3. The axis 52 of the power take-off pulley or wheel 25, i.e., its projection upon the plane formed by the axes 48 and 51 always intersect the pivot axis 48 at the center of the power take-off pulley or wheel 25, as will be evident from FIG. 3.

While there are shown and described present preferred embodiments of the invention, it is to be distinctly understood that the invention is not limited thereto, but may be otherwise variously embodied and practiced within the scope of the following claims.

Accordingly, What I claim is:

1. A cutter apparatus for producing at least one surface of a cutter head at a hardened steel cutter blade, comprising:

a drive motor;

a cutter grinding disk pivotably mounted about a predetermined pivot axis;

a belt drive drivingly interconnecting said drive motor and said cutter grinding disk;

said belt drive containing a drive pulley operatively associated with said drive motor;

a power take-off pulley operatively associated with said cutter grinding disk;

a drive belt for operatively connecting said drive pulley with said power take-off pulley;

a mounting device for the cutter grinding disk and said power take-off pulley;

means for pivoting said mounting device about said predetermined pivot axis and therewith pivoting the cutter grinding disk essentially parallel to a movement plane in order to cut the surface of the cutter head at the cutter blade;

means for displacing said mounting device and thus the cutter grinding disk relative to said drive motor along a predetermined displacement path and substantially along said predetermined pivot axis in order to compensate for wear of the cutter grinding disk;

said power take-off pulley having a width which exceeds the width of the drive belt by an amount which corresponds to said predetermined displacement path of said mounting device and thus of the cutter grinding disk; and means defining an adjustable reference surface for setting said movement plane and thus to enable positioning of the cutter grinding disk in a desired cutting plane.

2. The cutter apparatus as defined in claim 1, wherein:

the drive pulley has an axis which encloses an acute angle with the predetermined pivot axis.

3. The cutter apparatus as defined in claim 2, wherein:

said power take-off pulley has an axis; and said axis of the drive pulley is disposed substantially parallel to the axis of the power take-off pulley.

4. The cutter apparatus as defined in claim 3, wherein:

said power take-off pulley and said cutter grinding disk contain a common axis which, when projected on a plane defined by the mounting device, encloses an acute angle with said predetermined pivot axis.

5. The cutter apparatus as defined in claim 4, wherein:

said acute angle amounts to about 10°.

6. The cutter apparatus as defined in claim 2, wherein:

the axis of the drive pulley intersects the predetermined pivot axis essentially at the center of the drive pulley.

7. The cutter apparatus as defined in claim 2, wherein:

said power take-off pulley has an axis; and a projection of the axis of the power take-off pulley into a plane containing the axis of the drive pulley and the predetermined pivot axis intersects said predetermined pivot axis at the center of the power take-off pulley.

8. The cutter apparatus as defined in claim 1, wherein:

said means defining said adjustable reference surface is displaceable substantially parallel to said predetermined pivot axis.

9. A cutter apparatus for producing at least one surface of a cutter head at a hardened steel cutter blade, comprising:

a housing;

a drive motor rigidly connected to said housing;

a belt drive for driving a cutter grinding disk;

said belt drive containing a drive pulley operatively associated with said drive motor;

a power take-off pulley operatively associated with said cutter grinding disk;

a drive belt for operatively connecting said drive pulley with said power take-off pulley;

a mounting device for the cutter grinding disk and said power take-off pulley;

means for pivoting said mounting device about a pivot axis and therewith pivoting the cutter grinding disk substantially parallel to a predetermined movement plane in order to cut said surface of the cutter head at said steel cutter blade;

said cutter grinding disk having a front surface and two side surfaces and an axis which is inclined to said movement plane, the front surface producing said surface of the cutter head at said steel cutter blade;

means for selectively positioning the steel cutter blade;

means for displacing said mounting device and thus the cutter grinding disk along a predetermined displacement path relative to said drive motor and substantially axially with respect to said pivot axis;

said power take-off pulley having a width which exceeds the width of the drive belt by an amount which corresponds to said predetermined displacement path of said mounting device and thus of the cutter grinding disk; and means defining an adjustable reference surface for setting said movement plane and thus rendering possible positioning of the cutter grinding disk in a desired cutting plane.

* * * * *